US005588575A

United States Patent [19]

Davignon

[11] Patent Number: 5,588,575

[45] Date of Patent: Dec. 31, 1996

[54] NEEDLE FOR USE IN THE RODLESS DISPENSING OF PLASTIC FASTENERS

[75] Inventor: Paul A. Davignon, Uxbridge, Mass.

[73] Assignee: Avery Dennison Corporation, Pasadena, Calif.

[21] Appl. No.: 305,486

[22] Filed: Sep. 13, 1994

[51] Int. Cl.[6] ..... D05B 85/00; D05B 97/10; B25B 31/00

[52] U.S. Cl. ..... 227/67; 24/90.1; 112/222

[58] Field of Search ..... 227/67, 68, 70, 227/71, 72, 76; 112/222, 223, 224, 225, 226, 227, 110; 223/102; 24/72.7, 90.1, 456, 704.1

[56] References Cited

U.S. PATENT DOCUMENTS

| | | | |
|---|---|---|---|
| 3,399,432 | 9/1968 | Merser | 24/90.1 |
| 3,900,925 | 8/1975 | La Torraca | 24/90.1 |
| 4,128,067 | 12/1978 | Zocher | 112/222 |
| 4,316,562 | 2/1982 | Davidson et al. | 223/102 |
| 4,361,101 | 11/1982 | Marsh et al. | 227/68 X |
| 4,539,923 | 9/1985 | Long | 112/224 |
| 5,189,972 | 3/1993 | Mitsui et al. | 112/227 |

*Primary Examiner*—Joseph J. Hail, III

*Assistant Examiner*—Jay A. Stelacone

*Attorney, Agent, or Firm*— Kriegsman & Kriegsman

[57] ABSTRACT

Needle for use in the rodless dispensing of plastic fasteners of the type comprises a flexible filament and a cross-bar disposed at one end of the flexible filament. In one embodiment, the needle comprises a solid elongated member terminating at its front end in a tip adapted to penetrate a desired article of commerce and a chamber adapted to receive a cross-bar of a plastic fastener. The chamber includes a front end, a rear end, an open top and an open bottom. The open top, which is spaced rearwardly a distance from the tip, is appropriately sized and shaped to permit the insertion and removal of a cross-bar into and from the chamber. The front end is downwardly angled towards the tip to releasably engage the top surface of the front end of the cross-bar, and the rear end has a pair of walls intersecting in a V-shape to releasably engage both the top surface and the bottom surface of the rear end of the cross-bar in such a way as to prevent the cross-bar from being pulled out of the chamber through the open top when low tension is applied to the flexible filament (i.e., prior to the complete insertion of the cross-bar through the article of commerce), but yet, so as to cause the cross-bar to be pulled out of the chamber through the open top when high tension is applied to the flexible filament (i.e., following the complete insertion of the cross-bar through the article of commerce).

15 Claims, 3 Drawing Sheets

NEEDLE FOR USE IN THE RODLESS DISPENSING OF PLASTIC FASTENERS

BACKGROUND OF THE INVENTION

The present invention relates generally to needles useful in the dispensing of plastic fasteners and more particularly to a novel such needle.

Plastic fasteners of the type commonly used, for example, to attach merchandise tags or other items to articles of commerce, such as articles of clothing, are well-known and are widely used in the retail industry. Typically, such fasteners comprise an elongated unitary plastic member having a first end shaped to define a cross-bar (also commonly referred to as a "T-bar"), a second end shaped to define a paddle (or a second cross-bar), and a thin flexible filament portion interconnecting the cross-bar and the paddle. The cross-bar is typically sized and shaped to be inserted first through a merchandise tag and then through the article of commerce. The paddle is typically sized and shaped to prevent the tag from being pulled off the filament portion.

Typically, such fasteners are mass-produced by a molding process in either one of two different forms known as fastener stock. One type of fastener stock, which is disclosed in commonly-assigned U.S. Pat. No. 3,103,666 and which is incorporated herein by reference, comprises a plurality of fasteners joined together at their respective cross-bars by an orthogonally disposed runner bar. The other type of fastener stock, which is disclosed in commonly-assigned U.S. Pat. No. 4,955,475 and which is incorporated herein by reference, comprises a plurality of fasteners arranged in an end-to-end alignment, the heads and opposite ends of successive fasteners being joined together by severable connectors so as to form a continuously connected fastener stock.

The dispensing of individual fasteners from fastener stock into desired articles of commerce is typically accomplished using an apparatus commonly referred to as a "tagger gun." Examples of tagger guns are illustrated in commonly-assigned U.S. Pat. Nos. 5,320,269, 5,024,365, 4,121,487 and 4,456,161, all of which are incorporated herein by reference. Typically, a tagger gun includes (a) a hollow needle having a longitudinal slot extending across its length; (b) means for separating an individual cross-bar from the remainder of the fastener stock; and (c) means for feeding the individual cross-bar through the hollow, slotted needle and the desired article of commerce. (Connections, if any, between the paddles of a pair of adjacent fasteners are severed by pulling the tagger gun away from the article of commerce after the cross-bar of one of the fasteners has been inserted thereinto.)

Often, the aforementioned separating means comprises a knife element which is used to sever the severable connector located between a cross-bar and the runner bar or between adjacent cross-bars. In some instances, the knife element is attached to or is incorporated into the structure of the hollow, slotted needle in such a way that the severable connector is cut as a cross-bar is loaded into the hollow, slotted needle. An example of the foregoing is illustrated by U.S. Pat. No. 4,333,596, which is incorporated herein by reference. In this patent, a high strength needle assembly with a sharpenable cutting edge is disclosed, the assembly including a shank part having a tip and cylindrical hollow portion, a base part having a central bore and a knife part. The central bore has first and second sections, the first section having an inner diameter equal to the outer diameter of the cylindrical portion, such that the shank can be inserted therein and secured thereto by an adhesive. The second section has an inner diameter equal to the inner diameter of the cylindrical portion. The knife part includes a body portion with a cutting edge on one end and a protrusion on the other end, the protrusion being adapted to be received within and secured to a recess adjacent the second section of the bore. The knife part extends beyond the base in a direction substantially parallel to the axis of the base such that the cutting edge is accessible for re-sharpening.

Another example of a needle in which a knife element is incorporated thereinto is disclosed by U.S. Pat. No. 5,307,975, which is incorporated herein by reference. In this patent, there is disclosed a needle for use as part of a fastener dispensing tool, the needle being made from a single sheet of metal by a stamping and/or rolling technique, and comprising an elongated, generally cylindrical, hollow, slotted member having a stem portion and a base portion. The stem portion terminates at its front end in a relatively sharp tip. The base portion, a portion of which is sized and shaped for insertion in an opening in the nose of the tool, includes a pair of upwardly extending, spring tabs bent outwardly away from each other. A first portion of one of the tabs is sized and shaped to releasably engage a recessed area formed in the nose of the tool to prevent unintended removal of the base potion from the opening and to limit rearward insertion of the base portion into the opening. A second portion of the same tab is sized and shaped to engage another wall of the nose to prevent upward movement of the base portion in the opening. The other tab, serves as a registration member to align the base portion in its desired longitudinal, vertical and angular orientation.

In other instances, the hollow, slotted needle does not include a knife element, the knife element being located elsewhere in the tagger gun so that the severable connector is cut by the knife element prior to the loading of the individual cross-bar into the hollow, slotted needle. Examples of tagger guns employing this type of arrangement include commonly-assigned U.S. Pat. Nos. 5,320,269 and 4,998,661, both of which are incorporated herein by reference.

Typically, the above-mentioned means for feeding an individual cross-bar through the hollow, slotted needle and the desired article of commerce comprises an elongated ejector rod or plunger which is insertable into the slot of the hollow, slotted needle and is movable along its longitudinal axis. Typically, the ejector rod is coupled to a triggering mechanism in the tagger gun so that, upon actuation of the triggering mechanism, the ejector rod engages the rear of a cross-bar and pushes it through the hollow, slotted needle and the desired article of commerce.

As can readily be appreciated, because the ejector rod is a movable part, opportunities exist for the ejector rod to malfunction (for example, by becoming jammed in the tagger gun, by becoming disengaged from the triggering mechanism, etc.).

In U.S. Pat. No. 3,900,925, inventor La Torraca, which issued Aug. 26, 1975, there is described a simplified integral button attacher without any moving parts. The attacher consists of a needle having a hollow slotted end terminating in a point for insertion of one end of an improved fastener and a gripping means, attached to the opposite end of the needle, for simultaneously pushing the fastener loaded needle through a button aperture and the fabric to which it is to be attached.

SUMMARY OF THE INVENTION

It is an object of the present invention to provide a novel needle useful in the dispensing of plastic fasteners.

It is another object of the present invention to provide a novel needle useful in the dispensing of plastic fasteners that does not require the use of an ejector rod, a plunger or a similar device to discharge a cross-bar from a loaded needle after insertion of the loaded needle into a desired article of commerce.

In furtherance of the foregoing and other objects of the present invention which are set forth below or which are apparent from the present disclosure, there is provided herein a needle for use in dispensing a fastener of the type comprising a flexible filament and a cross-bar, the cross-bar being disposed at one end of the flexible filament, the needle comprising an elongated member, the elongated member terminating at its front end in a tip adapted to penetrate a desired article of commerce, the elongated member also having a chamber adapted to receive a cross-bar of a fastener, the chamber having an opening spaced rearwardly apart from said tip, said chamber being appropriately sized and shaped so that a cross-bar placed within said chamber through said opening and inserted through an article of commerce using the elongated member is retained within said chamber during insertion of the cross-bar through the article of commerce, but is discharged from said chamber through Said opening after insertion of the cross-bar through the article of commerce.

Preferably, the elongated member is a solid unitary body made of molded plastic or metal. The chamber is preferably shaped to include a front end, a rear end, a top and a bottom. The front end of the chamber is preferably shaped to releasably engage the top surface of the front end of a cross-bar disposed within the chamber, and the rear end of the chamber is preferably shaped to releasably engage both the top and bottom surfaces of the rear end of a cross-bar disposed within the chamber in such a way as to prevent the cross-bar from being pulled Out of the chamber when low tension is applied to the flexible filament but so as to cause the cross-bar to be pulled out of the chamber through the opening when high tension is applied to the flexible filament.

In one preferred embodiment, the front end of the chamber is angled down towards the tip of the elongated member so as to releasably engage the top surface of the front of a cross-bar disposed within the chamber, and the rear end of the chamber is shaped to include a pair of walls intersecting in a V-shape so as to releasably engage the top and bottom surfaces, respectively, of the rear of the cross-bar. In another preferred embodiment, the front end of the chamber is shaped to include a shelf adapted to releasably engage the top surface of the front end of a cross-bar disposed within the chamber, and the rear end of the chamber is shaped to include a substantially vertical wall having a notch, the notch being adapted to matingly receive and releasably engage the rear end of the cross-bar.

Preferably, the top of the chamber is open (the bottom of the chamber also preferably being open to facilitate manufacture of the chamber), the open top being appropriately sized and shaped to permit a cross-bar to be easily inserted into and removed from the chamber.

Because the needle of the present invention does not require an ejector rod or the like to eject a cross-bar therefrom, the needle reduces the number of moving parts and, thereby, eliminates many of the problems associated with the use of conventional devices which employ ejector rods and the like. Other advantages of the present needle over conventional needles are that the present needle may be formed into any of a wide variety of cross-sectional shapes and sizes and may be made from any of a wide variety of materials which are of sufficient strength to penetrate the desired article of commerce.

Additional objects, features and advantages of the present invention will be set forth in part in the description which follows, and in part will be obvious from the description or may be learned by practice of the invention. These embodiments will be described in sufficient detail to enable those Skilled in the art to practice the invention, and it is to be understood that other embodiments may be utilized and that changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
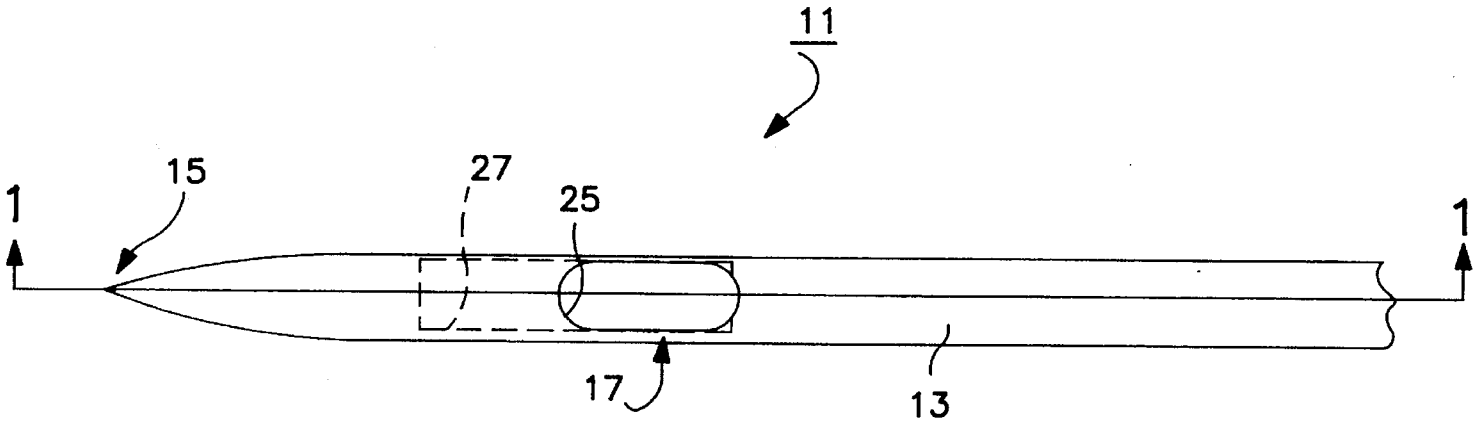
FIG. 1 is a fragmentary top view of a first embodiment of a needle constructed according to the teachings of the present invention for use in the rodless dispensing plastic fasteners.
Figure 2:
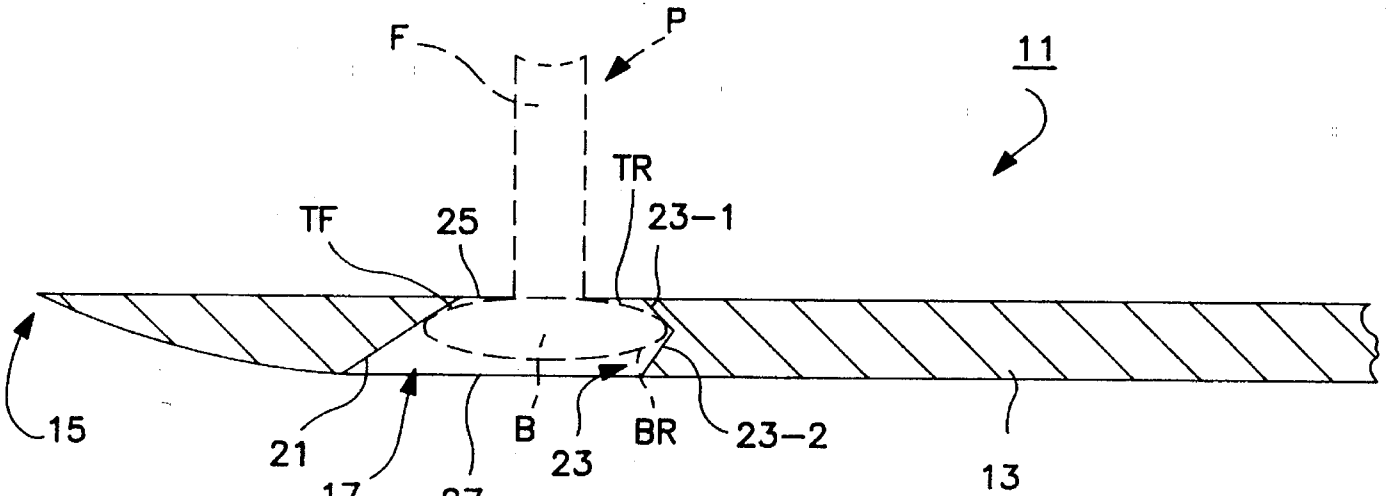
FIG. 2 is a fragmentary section view of the needle taken along line 1—1 in FIG. 1, the needle being shown loaded, in phantom, with a cross-bar of a plastic fastener.

Referring now to FIGS. 1 and 2, there are shown fragmentary top and section views, respectively, of a needle constructed according to the teachings of the present invention for use in the rodless dispensing of plastic fasteners, the needle being represented generally by reference numeral 11.

Needle 11 comprises an elongated member or shank 13, which is preferably a solid, unitary element which may be made, for example, of plastic or metal and may be formed by various techniques, such as molding, electroforming and stamping. Shank 13 is shaped to terminate at its front end in a relatively sharp, closed-ended tip 15 (as contrasted with the open, spoon-shaped tips of conventional needles) and is shaped to include a chamber 17 spaced rearwardly from tip 15.

Chamber 17, which is adapted to receive and retain, under the conditions specified below, a cross-bar B of a plastic fastener P, is defined by a front end 21, a rear end 23, an open top 25 and an open bottom 27. Open top 25, which is spaced rearwardly a distance from tip 15, is appropriately sized and shaped to permit the insertion and removal of cross-bar B into and from chamber 17. Front end 21 is shaped to releasably engage the top surface TF of the front of cross-bar B, and rear end 23 is shaped to releasably engage both the top surface TR and the bottom surface BR of the rear of cross-bar B in such a way as to prevent cross-bar B from being pulled out of chamber 17 through open top 25 when low tension is applied to the flexible filament F of fastener P (i.e., prior to the complete insertion of the cross-bar through the article of commerce), but yet, so as to cause cross-bar B to be pulled out of chamber 17 through open top 25 when high tension is applied: to flexible filament F (i.e., following the complete insertion of the cross-bar through the article of commerce). As seen best in FIG. 2, front end 21 angles downwardly towards tip 15 (for engaging top surface TF), and rear end 23 includes a top wall 23-1 angled down away from tip 15 (for engaging top surface TR of cross-bar B) and a bottom wall 23-2 angled down towards tip 15 (for engaging bottom surface BR of cross-bar B).

Although not shown, needle 11 could further include means of a conventional nature attached to the rear of shank 13 for mounting needle 11 in a tagger gun. Alternatively, needle 11 could be mounted in a tagger gun by other means, for example, by integrally forming needle 11 with a portion of the housing of a tagger gun.

Figure 3A:
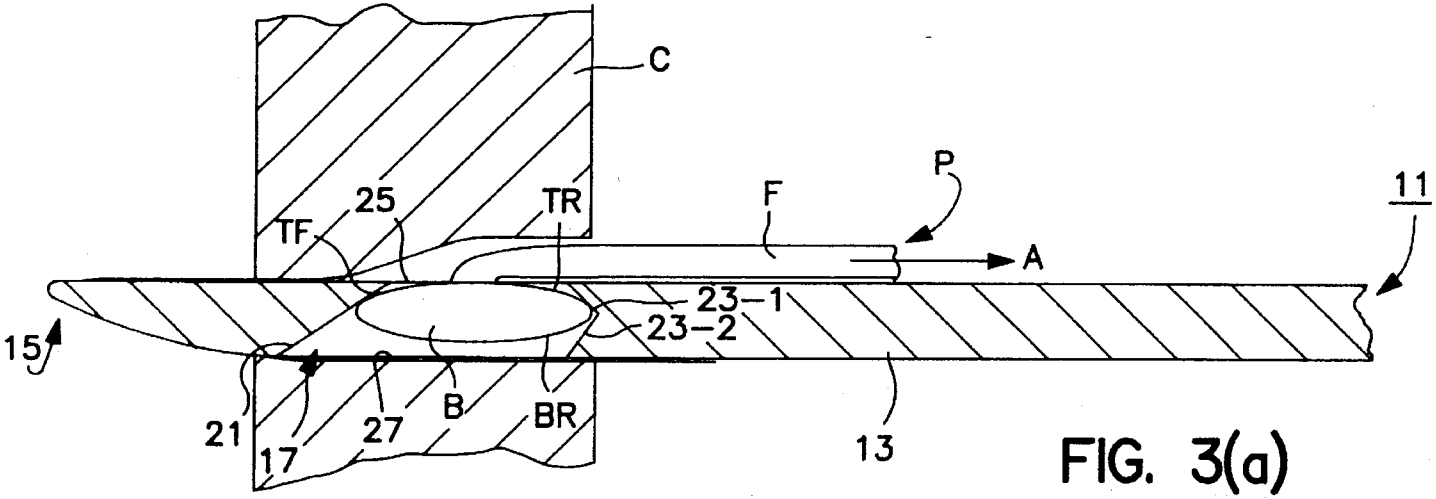
FIGS. 3(*a*) and 3(*b*) are fragmentary section views illustrating how the needle of FIG. 1 may be used in the rodless dispensing of a plastic fastener into an article commerce.
Figure 3B:
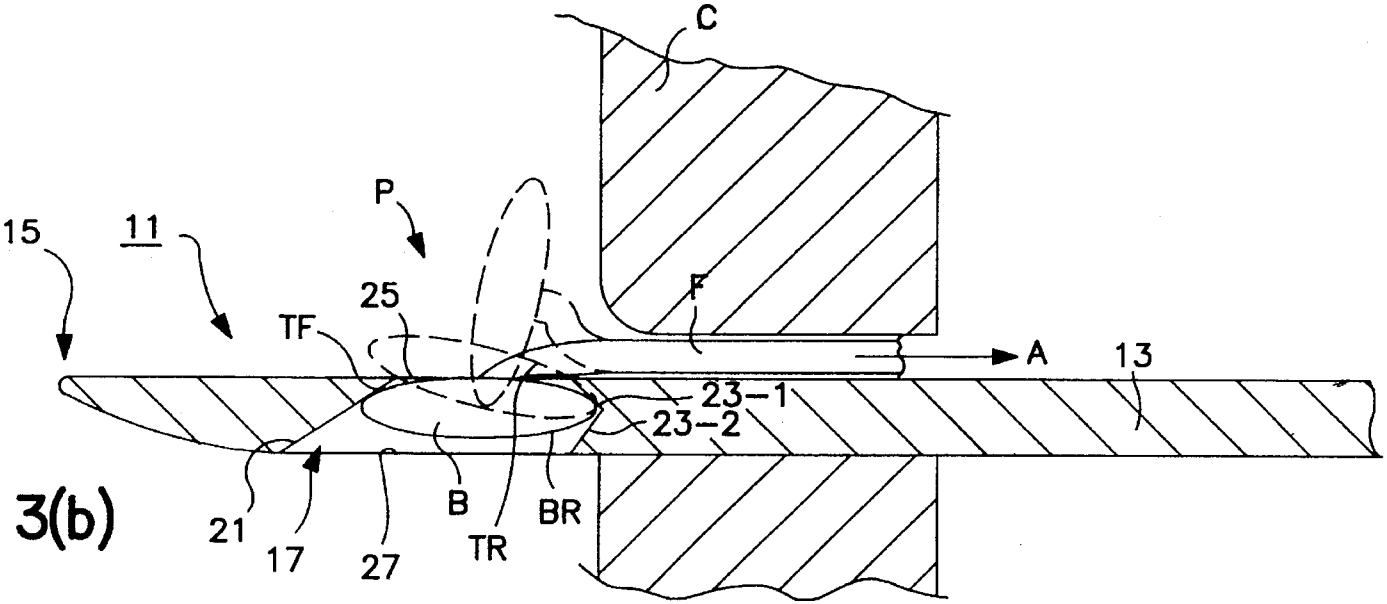

To use needle 11 in the rodless dispensing of a plastic fastener P into an article of commerce C, one first inserts the cross-bar B of plastic fastener P into chamber 17 through open top 25 so that top surface TF of the front of cross-bar B is engaged by front end 21 of chamber 17 and so that top surface TR and bottom surface BR of cross-bar B are engaged by walls 23-1 and 23-2, respectively, of chamber 17 (see FIG. 2). Next, one inserts cross-bar B through article of commerce C using needle 11. As can be seen in FIG. 3(*a*), during the insertion of cross-bar B through article of commerce C, the tension exerted on flexible filament F in the direction indicated by arrow A is sufficiently low so that front end 21 and rear end 23 are able to retain cross-bar B in chamber 17. However, as can be seen in FIG. 3(*b*), once cross-bar B has been fully inserted through article of commerce C, the tension exerted on flexible filament F in the direction indicated by arrow A increases to where it is sufficiently great to pull cross-bar B out of chamber 17 through open top 25.

As can readily be appreciated, one advantageous attribute of the present invention is that chamber 17 may be positioned at any number of locations along shank 13.

Figure 4:
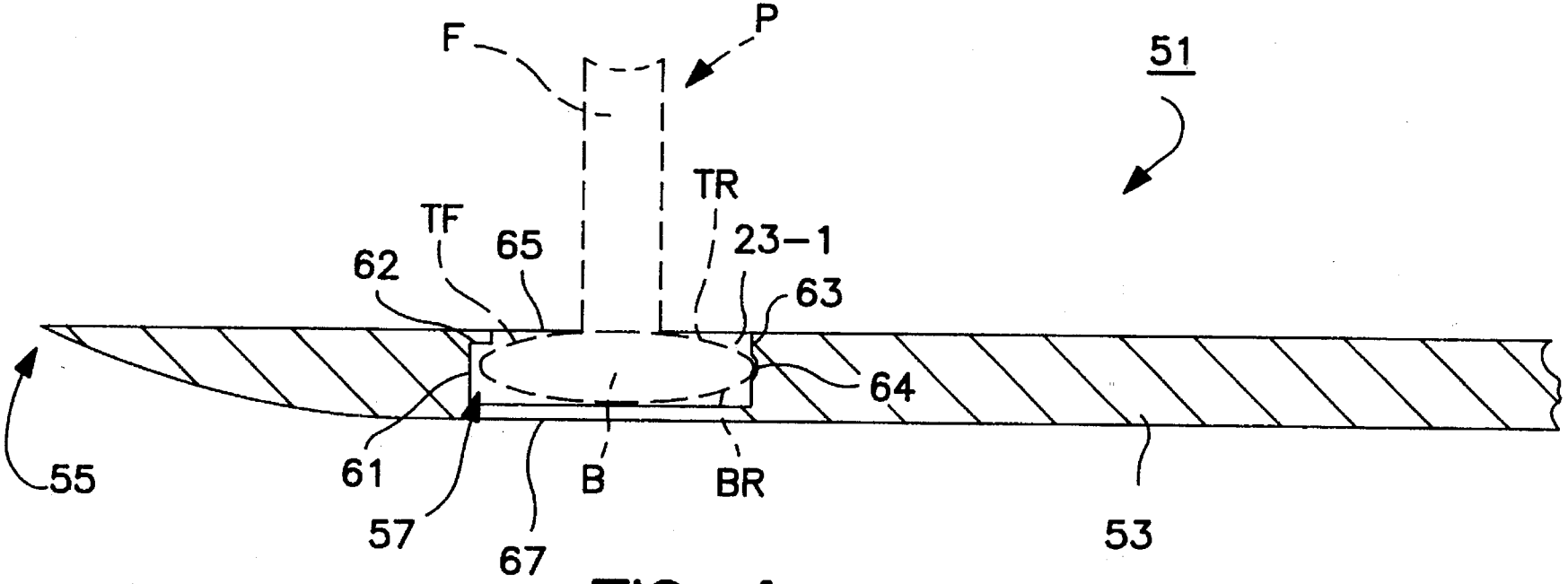
FIG. 4 is a fragmentary section view of a second embodiment of a needle constructed according to the teachings of the present invention for use in the rodless dispensing plastic fasteners, the needle being shown loaded, in phantom, with a cross-bar of a plastic fastener.

Referring now to FIG. 4, there is shown a section view of a second embodiment of a needle constructed according to the teachings of the present invention for use in the rodless dispensing of plastic fasteners, the needle being represented generally by reference numeral 51.

Needle 51, which is similar in many respects to needle 11, comprises an elongated member or shank 53, which is preferably a solid, unitary element which may be made from the same materials and by the same fabrication techniques as shank 13. Shank 53 is shaped to terminate at its front end in a relatively sharp tip 55 and is shaped to include a chamber 57 spaced rearwardly from tip 55.

Chamber 57, like chamber 17, is adapted to releasably hold a cross-bar B of a plastic fastener P and is defined by a front end 61, a rear end 63, an open top 65 and a bottom 67. Open top 65, which is spaced rearwardly a distance from tip 55, is appropriately sized and shaped to permit the insertion and removal of cross-bar B into and from chamber 57. Front end 61 is shaped to include a shelf 62 which is used to releasably engage the top surface TF of the front of cross-bar B, and rear end 63 is shaped to include a notch 64 for matingly receiving and releasably engaging both the top surface TR and the bottom surface BR of the rear of cross-bar B in such a way as to prevent cross-bar B from being pulled out of chamber 57 through open top 65 when low tension is applied to the flexible filament F of fastener P (i.e., prior to the complete insertion of the cross-bar through the article of commerce), but yet, so as to cause cross-bar B to be pulled out of chamber 57 through, open top 65 when high tension is applied to flexible filament F (i.e., following the complete insertion of the cross-bar through the article of commerce).

Needle 51 is used in the same manner described above for needle 11.

The embodiments of the present invention recited herein are intended to be merely exemplary and those skilled in the art will be able to make numerous variations and modifications to them without departing from the spirit of the present invention. All such variations and modifications are intended to be within the scope of the present invention as defined by the claims appended hereto.

What is claimed is:

1. A needle for use in dispensing a fastener of the type having a flexible filament and a cross-bar, the cross-bar being disposed at one end of the flexible filament, said needle comprising an elongated member, said elongated member terminating at its front end in a closed-ended tip adapted to penetrate a desired article of commerce, said elongated member also having a chamber adapted to receive a cross-bar of a fastener, said chamber having an opening spaced rearwardly h distance from said closed-ended tip, said chamber being appropriately sized and shaped so that, when the cross-bar is placed within said chamber through said opening and inserted through an article of commerce using said elongated member, the cross-bar is retained within said chamber during insertion of the cross-bar into the article of commerce but is discharged from said chamber through said opening when a predetermined tensile force is applied to said fastener after insertion of the cross-bar and chamber through the article of commerce.

2. The needle as claimed in claim 1 wherein said elongated member is solid, except for said chamber.

3. The needle as claimed in claim 1 wherein the cross-bar has a front, a rear and top and bottom surfaces and wherein said chamber includes a front end, a rear end, a top and a bottom, said top including said opening, said front end being shaped to releasably engage the top surface of the front of the cross-bar when the cross-bar is disposed within said chamber, said rear end being shaped to releasably engage the top and bottom surfaces of the rear of the cross-bar when the cross-bar is disposed within said chamber.

4. The needle as claimed in claim 3 wherein said front end angles downwardly towards said tip.

5. The needle as claimed in claim 3 wherein said rear end has a pair of walls intersecting in a V-shape.

6. The needle as claimed in claim 4 wherein said rear end has a pair of walls intersecting in a V-shape.

7. The needle as claimed in claim 3 wherein said front end is shaped to include a shelf engageable with the top surface of the front of the cross-bar.

8. A needle for use in dispensing a fastener of the type having a flexible filament and a cross-bar, the cross-bar being disposed at one end of the flexible filament and having a front, a rear and top and bottom surfaces, said needle comprising an elongated member, said elongated member terminating at its front end in a tip adapted to penetrate a desired article of commerce, said elongated member also having a chamber adapted to receive a cross-bar of a fastener, said chamber including a front end, a rear end, a top and a bottom, said top including an opening spaced rearwardly a distance from said tip, said front end being shaped to releasably engage the top surface of the front of the cross-bar when the cross-bar is disposed within said chamber, said rear end being shaped to releasably engage the top and bottom surfaces of the rear of the cross-bar when the cross-bar is disposed within said chamber, said rear end being a vertical wall provided with a notch, said notch being matingly engageable with the rear of the cross-bar, said chamber being appropriately sized and shaped so that, when the cross-bar is placed Within said chamber through said opening and inserted through an article of commerce using said elongated member, the cross-bar is retained within said chamber during insertion of the cross-bar through the article of commerce but is discharged from said chamber through said opening after insertion of the cross-bar through the article of commerce.

9. The needle as claimed in claim 7 wherein said rear end is a vertical wall provided with a notch, said notch being matingly engageable with the rear of the cross-bar.

10. A needle for use in dispensing a fastener of the type having a flexible filament and a cross-bar, the cross-bar being disposed at one end of the flexible filament and having a front, a rear and top and bottom surfaces, said needle comprising an elongated member, said elongated member terminating at its front end in a tip adapted to penetrate a desired article of commerce, said elongated member also having a chamber adapted to receive a cross-bar of a fastener, said chamber including a front end, a rear end, a top and a bottom, said top including an opening spaced rearwardly a distance from said tip, said bottom of said chamber being open, said front end being shaped to releasably engage the top surface of the front of the cross-bar when the cross-bar is disposed within said chamber, said rear end being shaped to releasably engage the top and bottom surfaces of the rear of the cross-bar when the cross-bar is disposed within said chamber, said chamber being appropriately sized and shaped so that, when the cross-bar is placed within said chamber through said opening and inserted through an article of commerce using said elongated member, the cross-bar is retained within said chamber during insertion of the cross-bar through the article of commerce but is discharged from said chamber through said opening after insertion of the cross-bar through the article of commerce.

11. The needle as claimed in claim 8 wherein said tip is closed-ended.

12. A needle for use in dispensing a fastener of the type having a flexible filament and a cross-bar, the cross-bar being disposed at one end of the flexible filament, said needle comprising an elongated member, said elongated member terminating at its front end in a closed-ended tip adapted to penetrate a desired article of commerce, said elongated member also having a chamber adapted to receive a cross-bar of a fastener, said chamber having an opening spaced rearwardly a distance from said closed-ended tip, said chamber being appropriately sized and shaped to prevent the cross-bar placed inside said chamber through said opening from being pulled out through said opening during insertion of the cross-bar into an article of commerce using said elongated member, and yet, to cause the cross-bar to be discharged from said chamber through said opening when a predetermined tensile force is applied to said fastener after insertion of the cross-bar and chamber through the article of commerce.

13. The needle as claimed in claim 12 wherein said elongated member is solid, except for said chamber.

14. The needle as claimed in claim 12 wherein the cross-bar has a front, a rear and top and bottom surfaces and wherein said chamber includes a front end, a rear end, a top and a bottom, said top including said opening, said front end being shaped to releasably engage the top surface of the front of the cross-bar when the cross-bar is disposed within said chamber, said rear end being shaped to releasably engage the top and bottom surfaces of the rear of the cross-bar when the cross-bar is disposed within said chamber.

15. The needle as claimed in claim 10 wherein said tip is closed-ended.

* * * * *